US006669770B1

(12) United States Patent
Goodwin

(10) Patent No.: US 6,669,770 B1
(45) Date of Patent: Dec. 30, 2003

(54) FACING SAND COMPOSITION AND METHOD OF INCORPORATION IN A MOLD

(76) Inventor: Thomas A. Goodwin, Box 964, Claresholm, Alberta (CA), T0L 0T0

( * ) Notice: Subject to any disclaimer, the term of this patent is extended or adjusted under 35 U.S.C. 154(b) by 0 days.

(21) Appl. No.: 10/328,034

(22) Filed: Dec. 26, 2002

(30) Foreign Application Priority Data

Dec. 20, 2002 (CA) ..... 2414798

(51) Int. Cl.[7] ..... B28B 7/28; B28B 7/34; B28B 7/36

(52) U.S. Cl. ..... 106/38.22; 106/38.2; 164/6; 164/14; 164/18; 164/23; 164/520; 164/525; 164/528; 164/45

(58) Field of Search ..... 106/38.2, 38.22; 164/6, 14, 18, 23, 520, 525, 528, 45

(56) References Cited

U.S. PATENT DOCUMENTS 5,275,114 A * 1/1994 Hughes ..... 106/38.3
5,275,648 A * 1/1994 Cobett et al. ..... 106/38.2
5,695,554 A * 12/1997 Landis ..... 106/38.2

* cited by examiner

*Primary Examiner*—Michael Marcheschi
(74) *Attorney, Agent, or Firm*—Sean W. Goodwin

(57) ABSTRACT

A sand casting facing composition comprises a dry mixture of about 77% fine sand, 5% binder, 6% green system sand and 12% burned system sand. The fine sand is mulled with 5.8% wt/wt oil per total dry mixture and catalyst at about 0.5% wt/wt. Preferably, fine sand and binder are mulled with oil, catalyst, green system sand and screened burned system. The mulled mixture is rested, mulled again and rested again before use as facing sand for achieving accurate reproduction of the pattern's fine detail. A method of preparing the mold and preserving fine detail comprises riddling the pattern with a thin layer of the facing sand composition, compacting, riddling with dry system sand and riddling with system sand before compacting about the periphery of the pattern. Final layers of system sand are applied and compacted over the entire pattern.

13 Claims, 5 Drawing Sheets

Fig. 5b
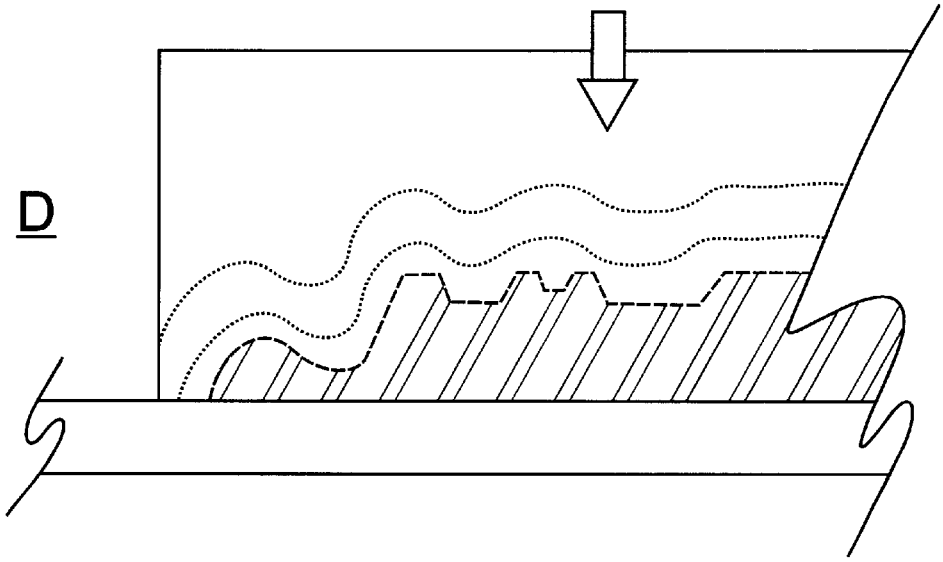
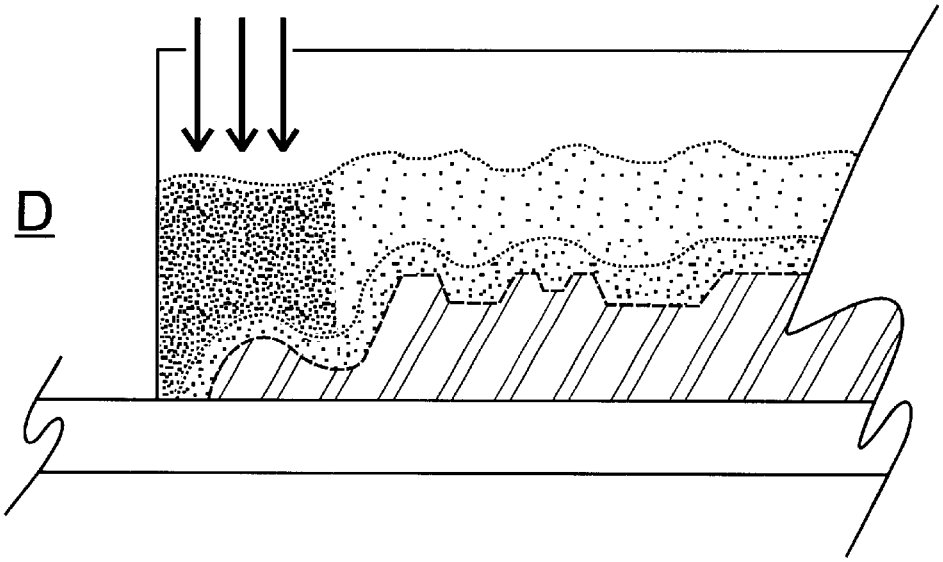
Fig. 5c

Fig. 5d
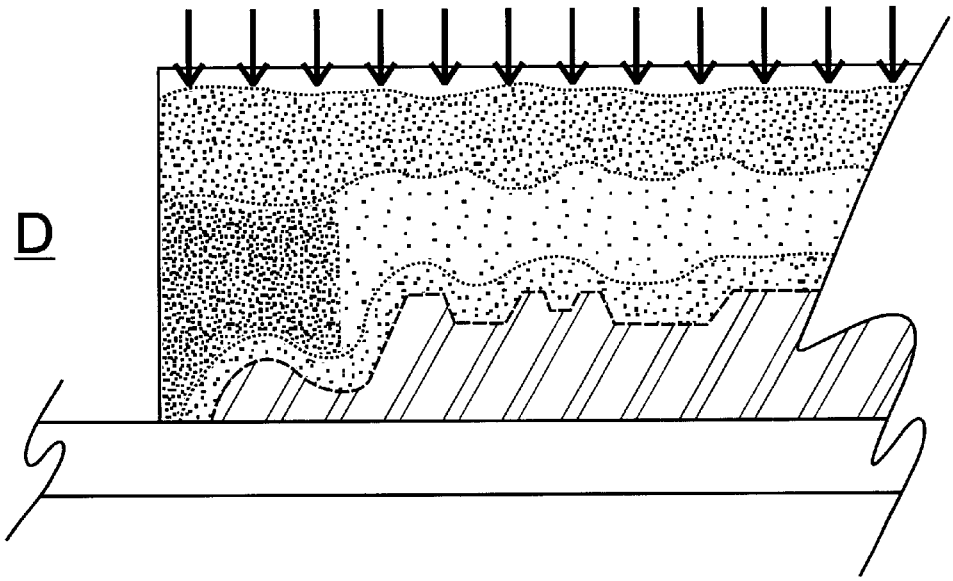
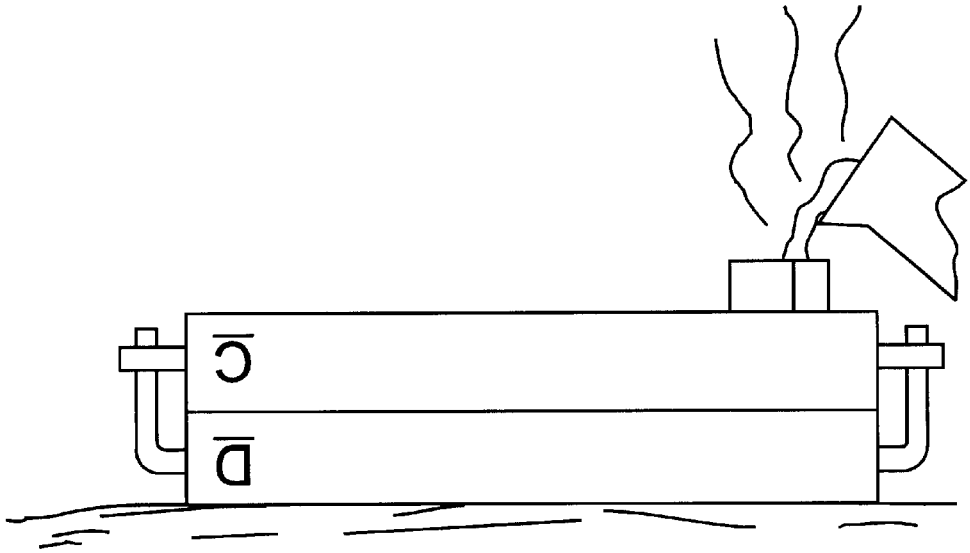
Fig. 6

FACING SAND COMPOSITION AND METHOD OF INCORPORATION IN A MOLD

FIELD OF THE INVENTION

The present invention is related to formulations and methods of use of foundry facing and system sand. More particularly a facing sand composition is provided for the retention of casting detail and reduction in casting defects.

BACKGROUND OF THE INVENTION

The conventional process of sand casting is simply one of forming a hollow mold of a composition of sand and an oil binder and filling it with molten material. A typical casting material is bronze. The binder enables the sand to be molded and to hold its shape as molten metal flows into the cavity defined by the mold. The mold is formed by packing the sand composition about a pattern on a pattern board, removing the pattern to leave a cavity in the formed sand, forming in the sand additional sprues, gates and vents as needed, and pouring the molten material into the cavity. The facing surface of the formed sand dictates the quality or texture of the finished solidified cast product which is ultimately extracted from the sand.

Typically, where it is an objective to produce sand castings having fine surface detail, various difficulties are encountered. For example in the prior art, and as shown in FIG. 1, when using a pattern such as a commemorative plaque having letter or type with partially or tightly facing internal shapes such as "B", "P", "H" and "A", sand can remain stuck in the enclosed spaces upon removal of the pattern with the result that the cast letters fill in during casting. Similarly, detail can be lost for patterns having intricate bas relief designs.

Others have partially alleviated this difficulty through the use of a specialized sand composition facing the pattern that contains a greater proportion of finer sand than the remaining bulk of the sand or system sand. System sand typically has a coarser Grain Fineness Number (GFN) of about 70 while finer facing sand is often between a GFN of about 120 and 180. Such fine facing sands can contain clays and are typically less permeable than system sand. Further attempts to increase the cohesive characteristics of the finer sand further reduces the permeability which impedes the escape of burned oil products during hot metal pours and results in "blows" or voids in the resulting casting. The formulation of a fine facing sand is a balance of conflicting characteristics: finer sand providing lower permeability and the binders and other ingredients needed for such compositions further occluding channels between the particles of sand.

Further, tightly packed facing sand is less subject to washing out when the molten metal flows by. Hard compaction is another characteristic which is in conflict with retaining sufficient permeability to permit the release of generated gases and preserve the integrity of the mold.

While it is known to provide specialized facing sand compositions, there is still a need for economical and robust compositions which result in superior performance and surface finishes and which can also be applied successfully using the tools and techniques of the smaller foundries.

Further difficulties are faced when hand tools are used to form the drag and cope of a mold and the methods of applying and compacting the facing sand and the added system sands can additionally and negatively impact the finish of the cast product. Improved methodology are required to assist the facing sand and maintaining a superior surface finish.

SUMMARY OF THE INVENTION

A sand casting formulation or composition establishes a balance between providing a fine surface for a superior finished surface and providing maximum permeability for enabling release of gas and maintaining integrity of the mold. Additionally, a novel method of sand application and compaction complements the disclosed composition for maintaining the fine surface finish with a minimum of distortion.

In a preferred embodiment, a facing sand composition is provided which comprises a dry mixture of sand and binder, oil and catalyst. Based on fine sand, a dry mixture is prepared preferably comprising 6% wt/wt binder to fine sand, 8% wt/wt green system sand to fine sand and 12% wt/wt burned system sand to fine sand. Once the oil and catalyst are added to the sand and binder, the proportions being about 8% wt/wt oil to fine sand and 0.5% wt/wt catalyst to fine sand. In a preferred order, the fine sand is mulled with the binder. The green system sand and screened burned system are added and mulled with the fine sand. The oil and catalyst are added. Preferably the catalyst is added last or at least after the binder has been distributed throughout the fine sand fine. The mulled mixture is allowed to rest, is mulled again and allowed to rest again before use.

To ensure accurate reproduction of the pattern's fine detail, a preferred method of forming the mold is provided. Preferably the cope is prepared in a cope flask. Then the drag, typically bearing the detail, is prepared by first riddling the novel facing sand in a layer over the detail portion of the pattern and compressing it thereon. The facing sand is then backed by riddling a layer of drier system sand over the facing sand to a similar depth as the facing sand and compressing it thereon. A thick layer of system sand is then applied over the entire pattern including over the sides of the pattern and the thick layer of system sand is compacted about the perimeter of the pattern. A further lift of system sand is then applied to span the entire area of the drag flask and is compacted hard about and over the pattern.

BRIEF DESCRIPTION OF THE DRAWINGS

FIG. 1 is an enlarged perspective view of a sand mold and an extracted foundry letter "A" illustrating how the enclosed center of the "A" inappropriately retains the prior art facing sand and thus fills in the center when cast;

FIG. 5*b* is a partial close up of a side view according to FIG. 5*a* having had a further lift of dry system sand added over the facing sand;

FIG. 5*c* is a partial close up of a side view according to FIG. 5*b* having had a further lift of system sand added and rammed abut the periphery of the pattern;

FIG. 5*d* is a partial close up of a side view according to FIG. 5*c* having had a final lift of system sand added and rammed thoroughly across the drag flask, filled and struck off level; and FIG. 6 is a side view illustrating the flasks wit the pattern removed and the cope flask and sprue positioned for receiving a pour of molten metal.

DETAILED DESCRIPTION OF THE PREFERRED EMBODIMENT

Figure 1:
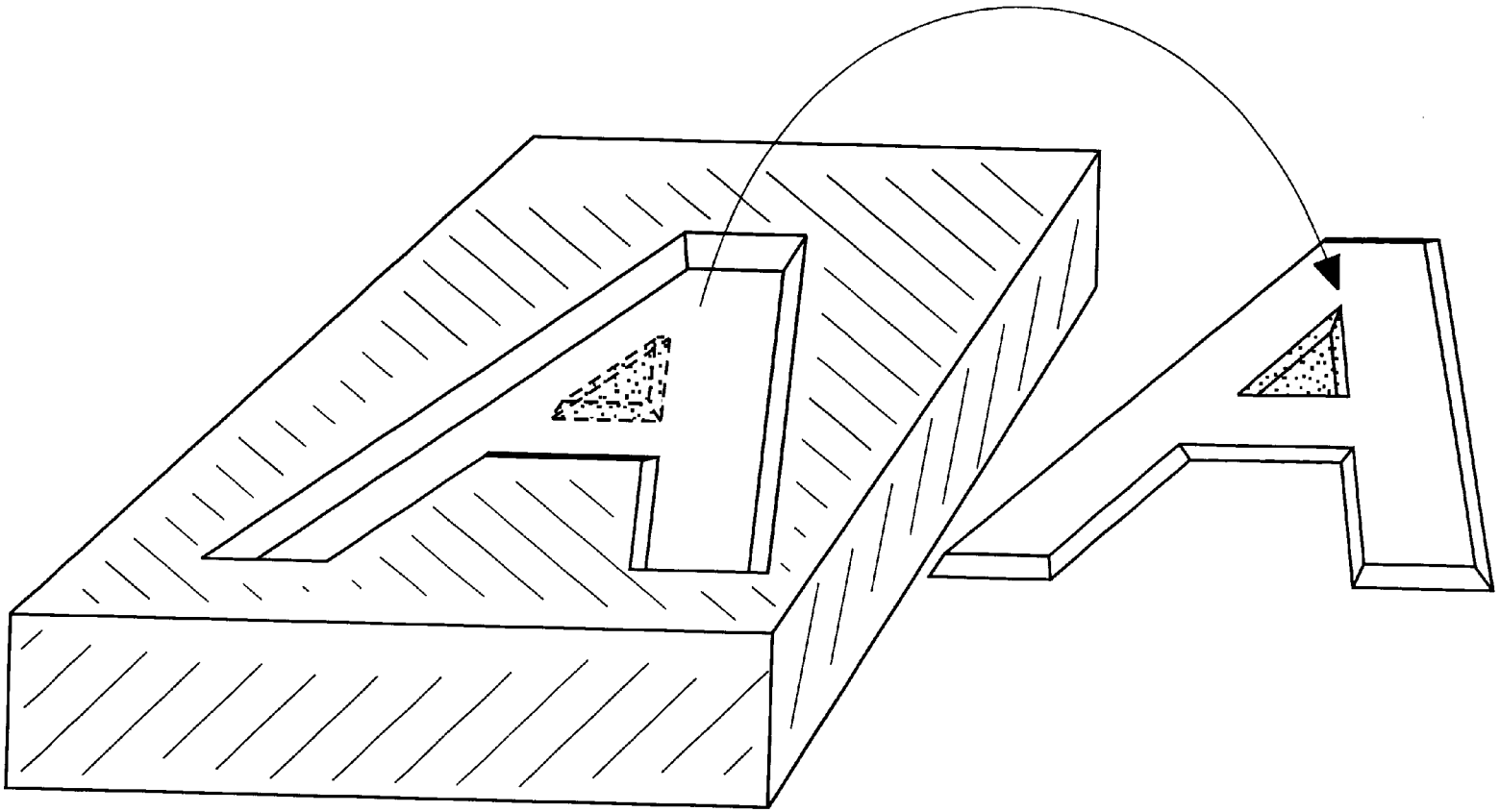
Fig. 1 PRIOR ART
FIG. 1 is a fanciful illustration of a prior art problem, more particularly

A facing sand composition for retaining the fine detail in foundry applications comprises a unique mixture of sand, binder, oil and a catalyst. The mixture combines green and burned sand. In use, a first facing sand prepared in accordance with the invention and applied to the pattern is backed with a second dry sand composition, and which is further backed with third conventional system sand composition. The novel methodology of application complements the novel facing sand and results in improved surface finishes without increased susceptibility to defects, and even with reduced defects.

For forming the first facing sand, a fine green sand is prepared and missed with some new green system sand and some burned sand.

The new fine green sand comprises fine silica sand, a binder, oil and a catalyst. For detail having tightly facing internal shapes, even with dimensions as small as 1 mm in relief, it is preferable to use fine silica sand having a GFN of about 120. This fine sand forms the bulk of the facing sand. The binder is a PETROBOND® binder available from Bentonite Performance Materials, Denver, Colo. According to the manufacturer, this binder is a proprietary mixture of sodium montmorillonite and quaternary amine. The manufacturer recommends use of oil such as a paraffin pale oil although other conventional refined oils without inhibitors or naphthenic oil with a flash points over 400° F. are suitable. Oils having a relatively low viscosity are preferred. An example of such an oil is Chevron Utility 100 oil. A material safety data sheet (MSDS) for which the oil described its characteristics as a severely refined petroleum distillate. Bentonite Corporation provides a paraffin pale oil described in its MSDS as a solvent dewaxed heavy paraffinic petroleum distillate. Suitable catalysts include that known as "P1 Catalyst" provided by Bentonite Performance Materials which is a propylene carbonate. Similarly methyl hydrate is known to serve as a catalyst.

Some second depleted sand is obtained most conveniently from previous casting as burned sand. Such sand is low in oil and binder and contains a mixture of burned first fine sand and burned third system sand. Such sand has had the oil and binder at least partially burned out, or depleted, during a prior pour. The burned sand is screened prior to mixing with the fine green sand.

Some coarse green sand, which is typically available and used as a conventional system sand, is also provided for mixing with the fine green sand. Such system sand preferably comprises silica sand having a GFN of about 70, PETROBOND® binder and oil. Typical proportions for coarse green sand comprise, for a total weight of 107 lbs., 100 lbs. of coarse sand GFN 70 (92% wt/wt), 5 lbs. binder (5% wt/wt), 2 lbs. oil (2% wt/wt)and about 1 ounce of catalyst.

In preparing the facing sand composition, the fine silica sand and the PETROBOND® binder together constituting the dry ingredients of the fine green sand, are mixed in a muller. The oil and the catalyst are mulled into the dry ingredients to form a fine green sand. The coarse green sand and the burned sand which complete the ingredients for the facing sand composition are mixed into the mixed fine green sand. The green system sand and screened burned system are added to, and mulled with, the fine sand. The mixture is allowed to rest, mulled again and again allowed to rest before use.

| | | | On a % of Fine Sand | | |
|---|---|---|---|---|---|
| Component | | Weight. | Pref | Range | % of Fine |
| Fine Silica sand | GFN 120 | 50 lbs. | | | |
| Binder | PETROBOND ® | 3 lbs. | 6% | 2.5–3.5 | 5–7% |
| Oil | | 4 lbs. | 8% | 2–5 | 4–10% |
| Catalyst | P1 Catalyst | 6 oz. | 0.8% | 5.4–6.6 | 0.7–0.8 |
| Coarse green sand | | 4 lbs. | 8% | 3–5 | 6–10 |
| Burned sand | | 8 lbs. | 16% | 7–9 | 14–18 |

The proportions can vary somewhat. It has been determined for the fine green sand, that for each 50 lbs of fine silica sand it is preferred to have greater than 2 lbs. of oil with the preferred quantity being about 4 lbs. Despite some variation in oil fraction, the amount of binder typically does not vary more than about between 2.5 and 3.5 lbs. The fraction of the remainder of the components may vary within 10–25% based on the crude precision practiced in the empirical testing performed in the casting trials.

The mixture can be mulled and remulled according to the preference of the individual craftsman. A successful mixture is one which has an appearance and texture of clay. To achieve this result, the facing sand composition can be mulled for about 20 minutes and then allowed to rest for 15 minutes, mulled for a further 10 minutes, and allowed to rest again for another 30 minutes.

As a result, on a dry basis (less any oil and catalyst), the preferred facing composition is about 77% fine sand, 5% binder, 6% coarse green system sand and 12% burned system sand totaling 100%. Relative dry and wet components are sand (about 93.7% wt/wt total dry components) with 5.8% wt/wt oil and about 6 ounces or 0.5% wt/wt catalyst totaling 100%.

The success of the first facing sand composition to accurately reproduce fine detail is further enhanced by an improved method of forming the mold. The complementary methodology is in two phases: one in the use and application to two different backing sands over the facing sand; and secondly in the method of compaction of the two backing sands.

Figure 2:
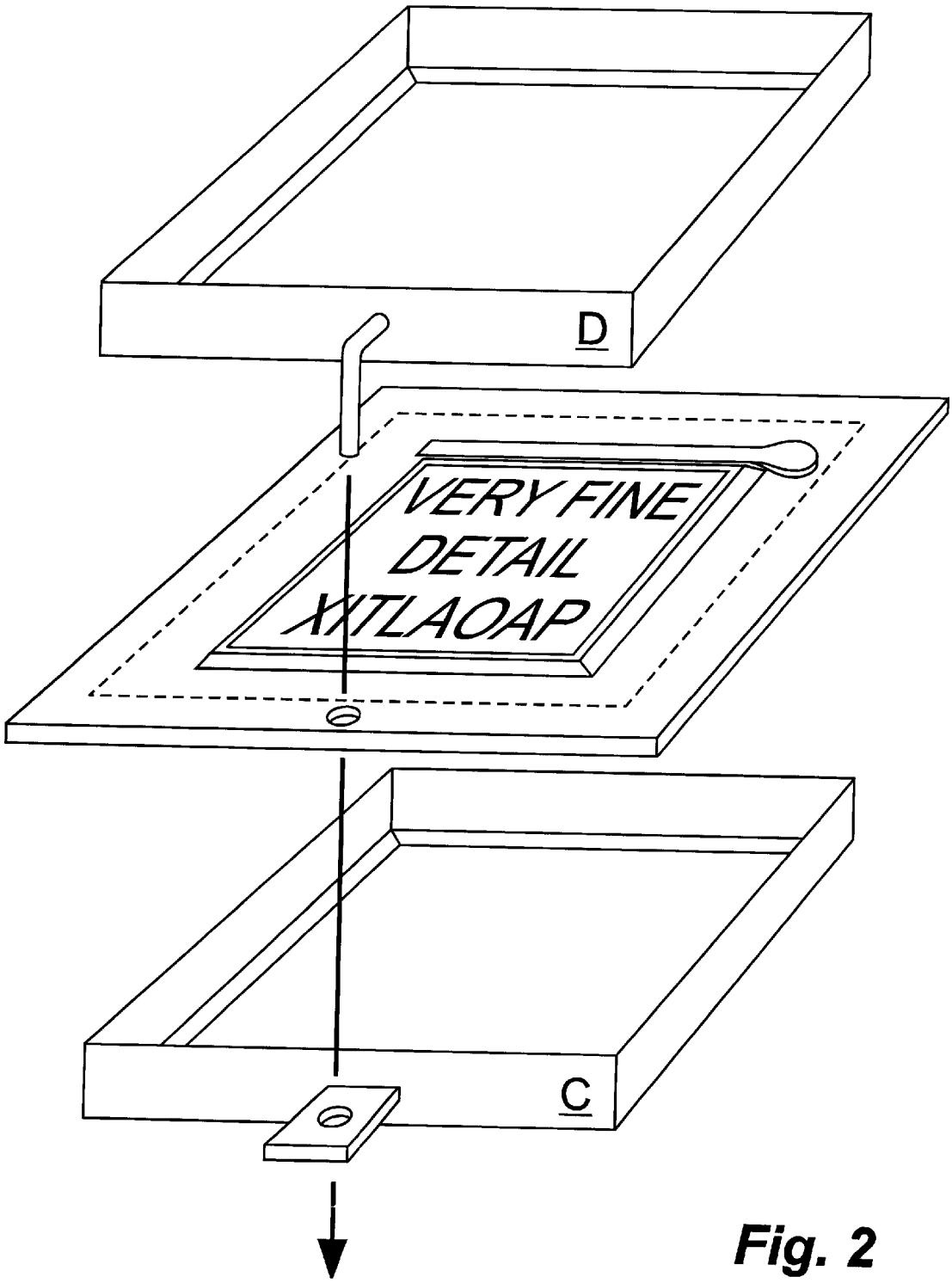
FIG. 2 is a perspective exploded view of a both halves of a conventional cope flask, pattern board and drag flask.

To ensure accurate reproduction of the pattern's fine detail, a preferred method of forming the mold is provided. As shown in FIG. 2, a typical mold is formed by sandwiching a pattern board between a cope flask C and a drag flask D. The following methodology is known to be suitable for rectangular patterns of up to about 24" by 20" without collapse of the cope. Known techniques for larger areas include additional use of cross bars and chucks in the cope flask C.

Figure 3:
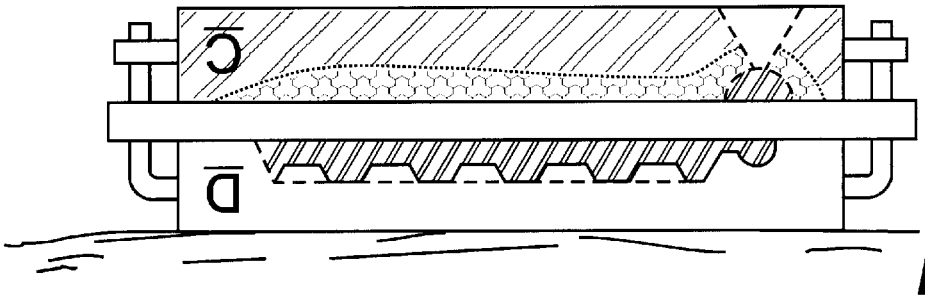
FIG. 3 is a side view of assembled flasks according to FIG. 2 with the cope flask facing upwardly and rammed with sand.

With reference to FIG. 3, typically the cope is prepared first. The cope typically contains the back of the casting. Clearly, for patterns having features on both sides, the side having the least intricate features is placed on the cope side. The cope flask C is oriented facing upwardly and system sand is applied. The back of the pattern board may contain the shapes of runners. The system sand in the cope flask C is compressed or rammed hard, 80 to 85 mold hardness or harder, to form the cope. Vent holes are formed in the cope. It is conventional to first apply a good quality system sand in a layer or lift over the back of the pattern board. As system sand is often rejuvenated from used sand, problems and even failures associated with inconsistent system sand can be avoided by applying a first layer of new coarse green sand to the pattern (such as about ⅜"–½"), and then filling the remainder of the cone flask C with either of a new system sand or rejuvenated system sand.

After already having prepared the cope, the drag portion bearing the most detailed of the patterns features is prepared so as to minimize distortion and stretch of the detailed features or image in the mold. The following procedure prevents or minimized "ram-away" wherein there is plastic deformation of the sand from around and away from the pattern and detailed features in particular.

Figure 4:
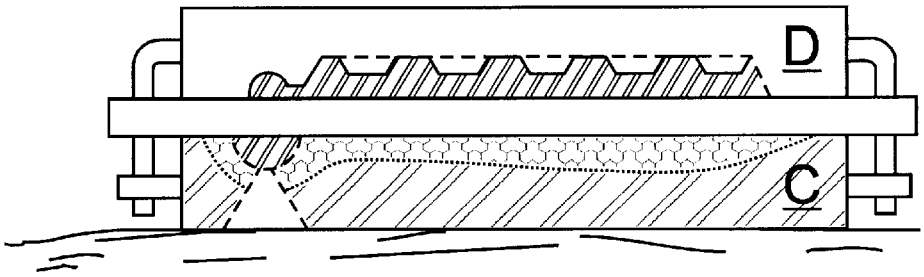
FIG. 4 is a side view of an assembled pattern according to FIG. 2 with the rammed cope flask facing downwardly exposing the drag flask for insertion of foundry sand.

As shown in FIG. 4, the mold is turned over to expose the pattern and the drag flask D.

Figure 5A:
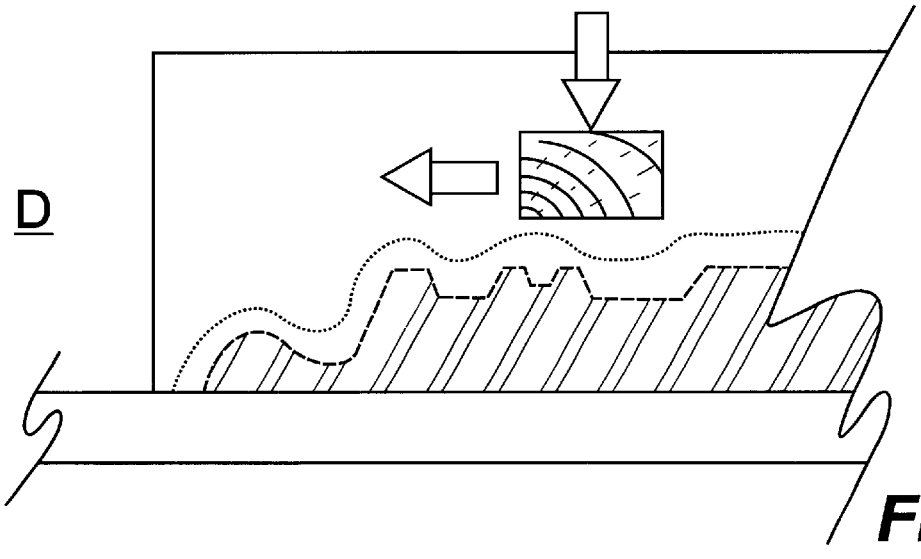
FIG. 5*a* is a partial close up of a side view of the assembled flasks according to FIG. 2 with the facing sand of the present invention being compressed onto the pattern.

With reference to FIG. 5*a*, in preparing the drag, a parting compound such as baby powder (talc or less preferably cornstarch) or powdered diatomaceous earth is preferably placed over the surface of the pattern. The fine facing composition of the present invention is then riddled or screened in a uniform layer over the detailed portion and sides of the pattern, the runners and gates. The facing sand is applied to a uniform thickness of between ⅜" and ½". The layer of facing sand composition is compressed evenly with a distributed pressure such as by applying a wooden block with hand pressure.

In FIG. 5*b*, a similar and uniform thickness of second dry sand is riddled or screened over the compressed facing sand composition. The dry sand contains less oil and less binder and is better suited to receive and absorb the gases created during the pour and thereby better avoid the possibility of a blow and the resulting damage to the surface finish of the casting. If the dry sand is barely capable of holding together then it is probably suitable. If the dry sand is cohesive when squeezed by hand then it is insufficiently burned and is too rich in oil or binder.

With reference to FIG. 5*c*, a thick layer of system sand is applied over the entire pattern. The system sand is compacted hard only about the periphery of the pattern, not over the pattern.

Finally, as shown in FIG. 5*d*, a final lift of systems sand is applied and is compacted hard about and over the entire drag flask D and over the pattern.

When the pattern board is removed and the molten metal is poured into the mold having utilized the fine facing sand composition and the mold preparation of the present invention, the resulting casting retains all the detail of the original pattern.

The embodiments herein are based on extensive empirical experience used to optimize the proportions of the composition and the procedure for preparing the mold. It is understood that the above embodiments are preferred and that some variations are included in the scope of the invention including variations in composition, and thicknesses and compression. For instance, those of skill in the art are aware of the need to adapt the sand composition, thickness and compression for differences between foundry letters which are ⅛" versus those which are larger. The shapes of flasks C,D and depth of patterns vary and the applied thickness of foundry sand will also vary.

What is claimed is:

1. A foundry facing sand composition for retaining fine surface detail comprising:

a fine silica sand;

from about 5–7% of a binder mixture of sodium montmorillonite and quaternary amine;

from about 4–10% refined oil;

from about 6–10% of coarse green sand;

between 14–18% burned sand; and a catalyst compatible with the binder mixture;

wherein all percentages are based on the weight of fine sand.

2. The facing sand composition of claim 1 wherein the fine silica sand has a GFN of about 120.

3. The facing sand composition of claim 1 wherein the coarse green sand contains silica sand having a GFN of about 70.

4. The facing sand composition of claim 1 wherein the composition contains 6% binder mixture, 8% oil, 0.8% catalyst, 8% coarse green sand, and 16% burned sand, all percentages being based on the amount of fine sand.

5. The facing sand composition of claim 1 wherein the fine silica sand has a GFN of about 120; and the coarse green sand contains silica sand having a GFN of about 70.

6. The facing sand composition of claim 5 wherein the composition contains 6% binder mixture, 8% oil, 0.8% catalyst, 8% coarse green sand, and 16% burned sand, all percentages being based on the amount of fine sand.

7. A method of preparing a facing sand composition for retaining surface detail comprising:

preparing a fine green sand comprising the steps of mixing a fine silica sand with between about 5–7% of a binder mixture of sodium montmorillonite and quaternary amine; and mulling the fine green sand with about 4–10% refined oil, a catalyst compatible with the binder mixture, about 6–10% of coarse green sand, and between 14–18% burned sand for forming the facing sand composition;

wherein all percentages are based on the amount of fine green sand.

8. The method of claim 7 wherein the fine silica sand is mixed with 6% binder mixture for forming a fine green sand, the method further comprising:

first mulling the fine green sand with 8% refined oil, 8% coarse green sand, 16% burned sand for forming a wet mixture; and then mulling the wet mixture with 0.8% catalyst.

9. The method of claim 7 wherein the fine silica sand is mixed with 6% binder for forming a fine green sand, the method further comprising:

first mulling the fine green sand with 8% refined oil and 0.8% catalyst for forming a wet mixture; and then mulling the wet mixture with 8% coarse green sand, and 16% burned sand.

10. A method of preparing a mold for retaining surface detail in a pattern comprising the steps of:

preparing a facing sand composition comprising the steps of mixing a fine silica sand with about 5–7% of a binder mixture of sodium montmorillonite and quaternary amine, mulling the fine sand with about 4–10% refined oil, and a catalyst compatible with the binder mixture, about 6–10% of coarse green sand, and about 14–18% burned sand for form a facing sand composition; optionally resting and mulling the facing sand composition, and wherein all percentages are based on the amount of fine sand;

arranging a pattern in a flask having at least a portion of the pattern containing surface detail;

riddling a thin layer of the facing sand composition over the pattern and surface detail and compacting the facing sand about the pattern;

riddling a thin layer of a dry system sand over the compacted facing sand;

riddling a layer of the dry system sand across the flask including over the pattern and compacting the dry system sand outside a periphery of the surface detail; and riddling a layer of dry system sand in across the pattern and compacting the dry system sand across the flask including over the pattern.

11. The method of claim 10 wherein the compaction step outside a periphery of the surface detail comprises compacting outside of a periphery of the pattern.

12. The method of claim 10 wherein the flask comprises a cope and a drag, the pattern being arranged to face the drag portion, the method further comprising:

preparing the cope;

turning over the flask; and then preparing the drag using the riddling steps.

13. The method of claim 10 wherein a parting compound is applied to the pattern before riddling the pattern with the facing sand composition.

* * * * *